US006437675B1

(12) United States Patent
Chu

(10) Patent No.: US 6,437,675 B1
(45) Date of Patent: Aug. 20, 2002

(54) LINEAR COIL ACOUSTIC NOISE INHIBITING

(75) Inventor: Aries Chu, Taipei Hsien (TW)

(73) Assignee: Acer Communications and Multimedia Inc., Taoyuan (TW)

( * ) Notice: Subject to any disclaimer, the term of this patent is extended or adjusted under 35 U.S.C. 154(b) by 0 days.

(21) Appl. No.: 09/699,068

(22) Filed: Oct. 27, 2000

(30) Foreign Application Priority Data

Dec. 4, 1999 (TW) ..... 88220698 U

(51) Int. Cl.[7] ..... H01F 27/00; H01R 11/30; H01R 13/60

(52) U.S. Cl. ..... 336/100; 439/38

(58) Field of Search ..... 439/559, 66, 271, 439/38; 336/100

(56) References Cited

U.S. PATENT DOCUMENTS 4,613,118 A * 9/1986 Mrita ..... 267/140.1
4,820,170 A * 4/1989 Redmond et al. ..... 439/66
5,947,766 A * 9/1999 Tsuji et al. ..... 439/579
6,114,934 A * 9/2000 Ikeda et al. ..... 336/100

* cited by examiner

*Primary Examiner*—Brian Sircus
*Assistant Examiner*—Chandrika Prasad
(74) *Attorney, Agent, or Firm*—Ladas & Parry

(57) ABSTRACT

A linear coil for inhibiting acoustic noise is provided. A rubber spacer is disposed in addition to the conventional linear coil. By means of the spacer, the vibration, generated when the deflection current passes through the linear coil, is absorbed. As a result, acoustic noise, caused by the collision between the linear coil and the printed circuit board, can be inhibited.

11 Claims, 5 Drawing Sheets

LINEAR COIL ACOUSTIC NOISE INHIBITING

BACKGROUND OF THE INVENTION

1. Field of the Invention

The present invention relates to a linear coil; in particular, the invention relates to a linear coil having the capability of inhibiting acoustic noises.

2. Description of the Related Art

A linear coil is usually installed in a display, for example, a CRT monitor or a television in which the linear coil is installed for a linear correction of such display. For instance, when the linear coil is installed on the printed circuit board of the display, the picture of the display can be linearly corrected by means of a deflection current of the linear coil. A typical structure of the conventional linear coil is described as follows with reference to the layout structure of the printed circuit board.

FIG. 1 shows a display 10, which is mainly consisted of a printed circuit board 11 and a deflection yoke 12. In addition, a flyback transformer 13, a horizontal width adjustment coil 14, and a linear coil 15 are also installed on the printed circuit board 11.

The structure of a conventional linear coil 20 is shown in FIG. 2, wherein the linear coil 20 comprises a compensation part 21, a linearity part 22, a magnetic portion 23, a base 24, and a plurality of connectors 25. The base 24, made of hard rubber, is used for supporting the compensation part 21, the linearity part 22, and the magnetic portion 23. The linear coil 20 may be fixedly disposed on the printed circuit board 11 by means of the connectors 25. The connectors 25, made of metal of high rigidity, include a first connector 251, a second connector 252, a third connector 253, and a fourth connector 254. Thereby, the base 24 may be fixedly disposed on the printed circuit board so as to electrically connect the linear coil 20 to the printed circuit board of the display. In addition, the magnetic portion 23 is a permanent magnet. The adhesion among the compensation part 21, the linearity part 22, the magnetic portion 23, and the base 24 for putting together a complete linear coil 20 is by means of an adhesive such as epoxy.

The linearity part 22 comprises a linearity core 221 and a first wire 222. For example, the linearity core 221 is made of ferrite, and the first wire 222 surrounds the linearity core 221. In addition, one end of the first wire 222 leads to the first connector 251, and the other end of the first wire 222 leads to the second connector 252.

The compensation part 21 comprises a compensation core 211 and a second wire 212. For example, the compensation core 211 is made of ferrite, and the second wire 212 surrounds the compensation core 211. In addition, one end of the second wire 212 leads to the third connector 253, and the other end of the second wire 212 leads to the fourth connector 254.

The structure of the conventional linear coil 20 is therefore described as above. On the other hand, the operating principle of the conventional linear coil 20 is described as follows.

The current from the printed circuit board flows to the first wire 222 of the conventional linear coil 20 via a connector, for example, the first connector 251. While the current flows in the first wire 222, it flows around the linear core 221. Then, the current flows back to the printed circuit board via another connector, for example, the second connector 252. Furthermore, as the deflection current flows around the linearity core 221, the resistance of the linearity part 22, that acts against the deflection current, linearly corrects the picture of the display 10 in order to attain a fine picture.

The compensation part 21 is used for spreading the operation range, and the operating principle of the compensation part 21 is similar to that of the linearity part 22. The current from the printed circuit board flows to the second wire 212 of the conventional linear coil 20 via a connector, for example, the third connector 253. While the current flows in the second wire 212, it flows around the compensation core 211. Then, the current flows back to the printed circuit board via another connector, for example, the fourth connector 254. Furthermore, as the deflection current flows around the compensation core 211, the compensation part 21 generates a magnetic field to influence the magnetic field generated by the linearity part 22. As a result, the characteristic curve of the linearity part 22 is shifted and the linear correcting range of the linearity part 22 is changed.

Furthermore, the magnetic portion 23 is a permanent magnet, wherein the function of the magnetic portion 23 is to shift the characteristic curve of the linearity part 22 to a linear zone.

The operating theorem of the conventional linear coil 20 is described as above. However, as the alternating current with high frequency flows around the linearity core 221, the linearity core 221 generates a magnetic force. Because the magnitude and direction of the alternative current keeps changing, the attraction force and the rejection force are repeatedly and periodically generated between the linearity part 22 and the magnetic portion 23. Such an attraction force or a rejection force may cause a collision between the linearity core 221 and the magnetic portion 23, which may eventually transfer this collision to the printed circuit board via the base 24 and the connectors 25. As a result, vibration in the printed circuit board can be generated accompanied with a high frequency acoustic noise. In addition, collision may also occur between the compensation part 21 and the linearity part 22, which is however not so obvious comparing with the collision between the linearity core 221 and the magnetic portion 23.

Referring to FIG. 3 and FIG. 4, a notch 2211 is provided atop the linearity core 221 of the conventional linear coil to accommodate the first wire 222. Nevertheless, such a conventional design makes the first wire 222 contact a sharp edge of the magnetic portion 23 near the top directly, as shown in FIG. 4. When the above-mentioned attraction force or rejection force are generated, a friction force is also generated between the first wire 222 and the sharp edge of the magnetic portion 23, which at the same time induces an undesirable acoustic noise.

Furthermore, the structure of another conventional linear coil 40 is as shown in FIG. 5, wherein a compensation core 411, a linearity core 421, and a magnetic portion 43 of the conventional linear coil 40 are assembled together following the same manner as the compensation core 211, the linearity core 221, and the magnetic portion 23 of the linear coil 20 described above; hence, the description is herein omitted for briefness. However, the differences between the linear coil 40 and the linear coil 20 are described as follows. First of all, the connectors 441, 442 of a base 44 of the linear coil 40 are used for simply fixing the base 44 to a printed circuit board. Secondly, two ends of a first wire 422 and two ends of a second wire 412 are electrically connected to the printed circuit board without being bound to the connectors as in the case of the linear coil 20.

However, as in the case of the linear coil 20, collision can still occur between the linearity core 421 and the magnetic portion 43, which generates a high frequency acoustic noise.

SUMMARY OF THE INVENTION

In view of the disadvantages of the conventional linear coil, the present invention provides a linear coil capable of reducing acoustic noises related thereto.

According to the present invention, a linear coil comprising a base, a spacer, a magnetic portion, and a linearity part is installed on a printed circuit board. The base is fixedly installed on the printed circuit board in such manner that the spacer is disposed on the base, that the magnetic portion is disposed on the spacer, and that the linearity part is disposed on the magnetic portion. Accordingly, the spacer prevents the vibration generated between the magnetic portion and the linearity part from being transferred to the printed circuit board via the base so as to inhibit the acoustic noise generated from the linear coil.

Furthermore, the linearity part comprises a linearity core and a first wire. The linearity core is disposed on the magnetic portion with the first wire looped around the linearity core and with both ends of the first wire electrically connected to the printed circuit board.

Furthermore, the base comprises a first connector and a second connector made of conductive material such that the base is fixedly disposed on the printed circuit board by means of the first connector and the second connector. Two ends of the first wire therefore are electrically connected to the printed circuit board via the first connector and the second connector respectively.

Furthermore, the linear coil comprises a compensation part that is disposed on the linearity part.

Furthermore, the compensation part comprises a compensation core and a second wire in such manner that the compensation core is disposed on the linearity part, that the second wire loops around the compensation core, and that two ends of the second wire are electrically connected to the printed circuit board respectively.

Furthermore, the base further comprises a third connector and a fourth connector such that the base is fixedly disposed on the printed circuit board by means of the third connector and the fourth connector. Two ends of the second wire therefore are electrically connected to the printed circuit board via the third connector and the fourth connector respectively.

Furthermore, the spacer is made of an elastic material, wherein an example of such elastic material is rubber.

Furthermore, the linear coil is disposed on a printed circuit board, and the linear coil comprises a base, a magnetic portion, and a linearity portion. Wherein, the base is fixedly disposed on the printed circuit board in such manner that the magnetic portion is disposed on the base, that the linearity part comprising a linearity core and a first wire is disposed on the magnetic portion, that the first wire loops around the linearity part, and that two ends of the first wire are electrically connected to the printed circuit board. Accordingly, a spacer is disposed between the base and the magnetic portion to prevent the vibration generated between the magnetic portion and the linearity part from being transferred to the printed circuit board via the base.

Furthermore, the linear coil is disposed on a printed circuit board, and the linear coil comprises a base, a magnetic portion, and a linearity part. Wherein, the base is fixedly disposed on the printed circuit board in such manner that the magnetic portion is disposed on the base, that the linearity part is disposed on the magnetic portion, and that at least one air bag is disposed inside the the base. Accordingly, the air bag prevents the vibration generated between the magnetic portion and the linearity part from being transferred to the printed circuit board via the base so as to inhibit the acoustic noise generated from the linear coil.

Furthermore, the linear coil is disposed on a printed circuit board, and the linear coil comprises a base, a magnetic portion, and a linearity part. Wherein, the base is fixedly disposed on the printed circuit board in such manner that the magnetic portion is disposed on the base and that the linearity part comprises a linearity core and a first wire. Furthermore, the linearity core is disposed on the magnetic portion with the first wire looped around the linearity part and with both ends of the first wire electrically connected to the printed circuit board. At least one elastic bag is disposed inside the base, and the elastic bag prevents the vibration generated between the magnetic portion and the linearity part from being transferred to the printed circuit board via the base.

BRIEF DESCRIPTION OF THE DRAWINGS

The invention is hereinafter described in detail with reference to the accompanying drawings, in which.

DETAILED DESCRIPTION OF THE INVENTION

First Embodiment

Figure 6:
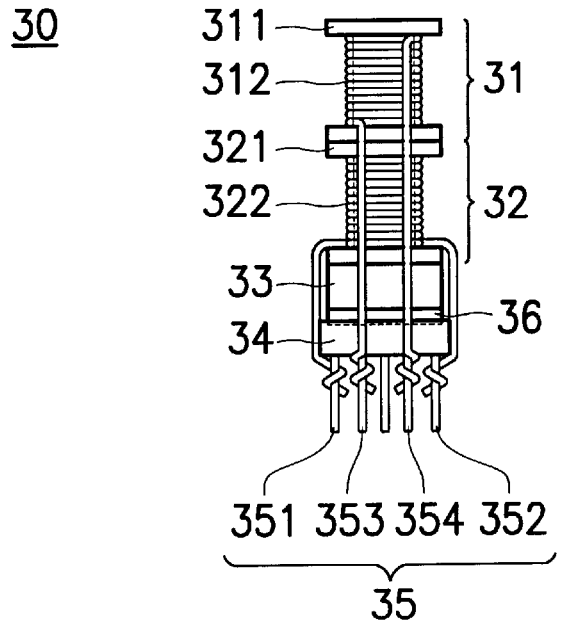
FIG. 6 is a plane view illustrating an embodiment of the linear coil according to the present invention.
Figure 7:
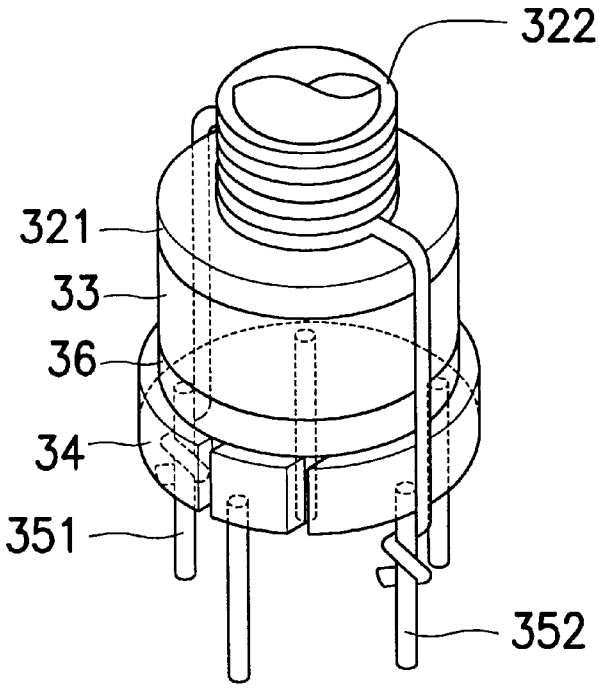
FIG. 7 is a perspective view of the linear coil shown in FIG. 6.
Figure 8:
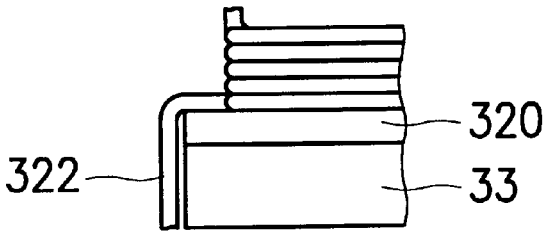
FIG. 8 is an enlarged view of the linear coil of the present invention shown in FIG. 7.

Referring to FIGS. 6, 7, and 8, FIG. 6 is a plane view illustrating an embodiment of the linear coil according to the present invention. FIG. 7 is a perspective view of the same linear coil as shown in FIG. 6, and FIG. 8 is an enlarged view of a portion of FIG. 7.

The structure of the linear coil 30 according to this embodiment is as shown in FIG. 6, wherein the linear coil 30 shown comprises a compensation part 31, a linearity part 32, a magnetic portion 33, a spacer 36, a base 34, and a plurality of connectors 35. The base 34, which is made of rubber in this embodiment, is used for supporting the compensation part 31, the linearity part 32, the magnetic portion 33, and the spacer 36. The linear coil 30 is fixedly disposed on and electrically connected to a printed circuit board by means of the connectors 35. Wherein, the connectors 35, which are made of a metal or an alloy with high rigidity, comprises a first connector 351, a second connector 352, a third connector 353, and a fourth connector 354.

Figure 1:
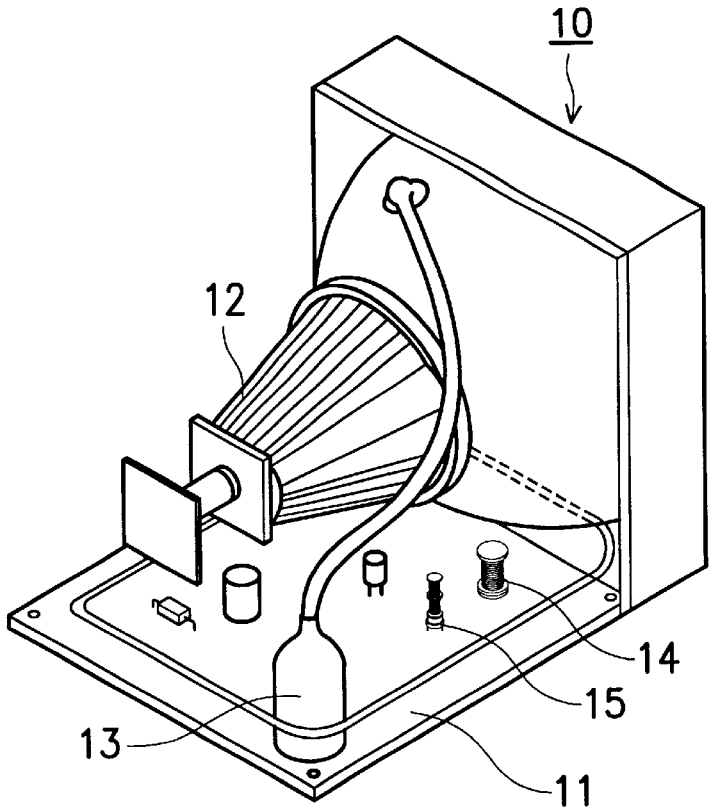
FIG. 1 (PRIOR ART)
FIG. 1 is a perspective view showing the main parts of a display, wherein a conventional linear coil is installed thereto.
Figure 2:
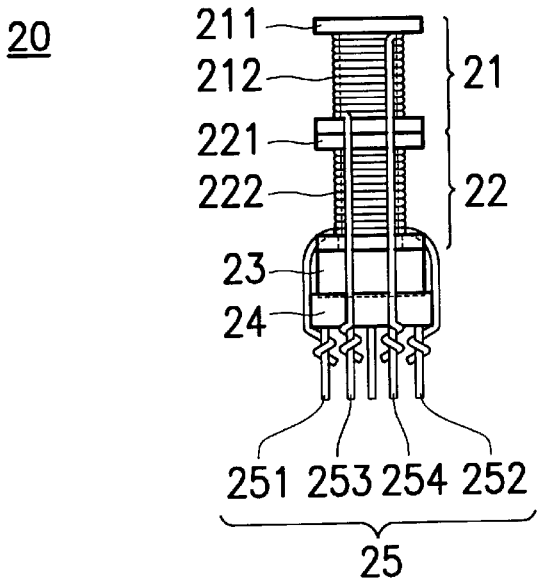
FIG. 2 (PRIOR ART)
FIG. 2 is a plane view of a conventional linear coil.
Figure 3:
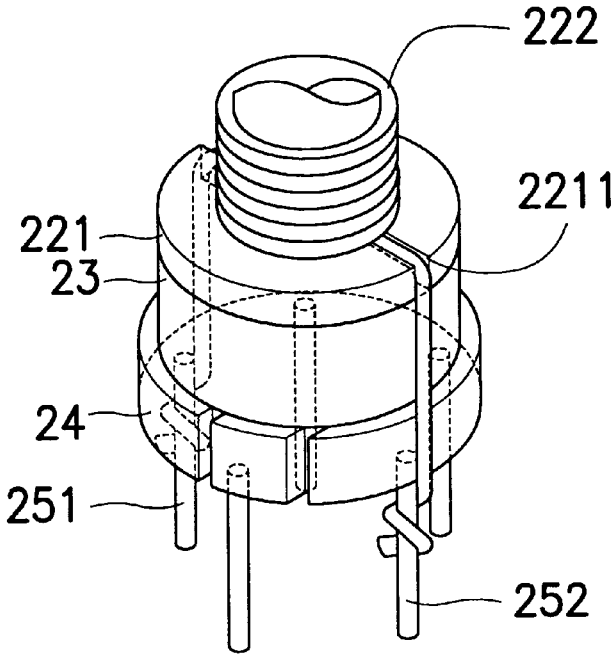
FIG. 3 (PRIOR ART)
FIG. 3 shows a perspective view of the conventional linear coil shown in FIG. 2.
Figure 4:
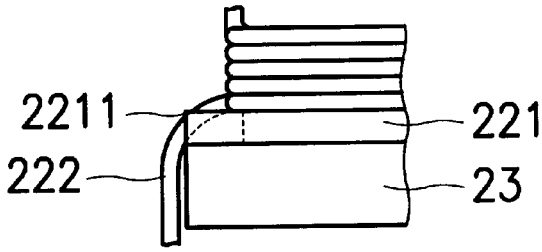
FIG. 4 (PRIOR ART)
FIG. 4 is an enlarged view of the conventional linear coil shown in FIG. 3.
Figure 5:
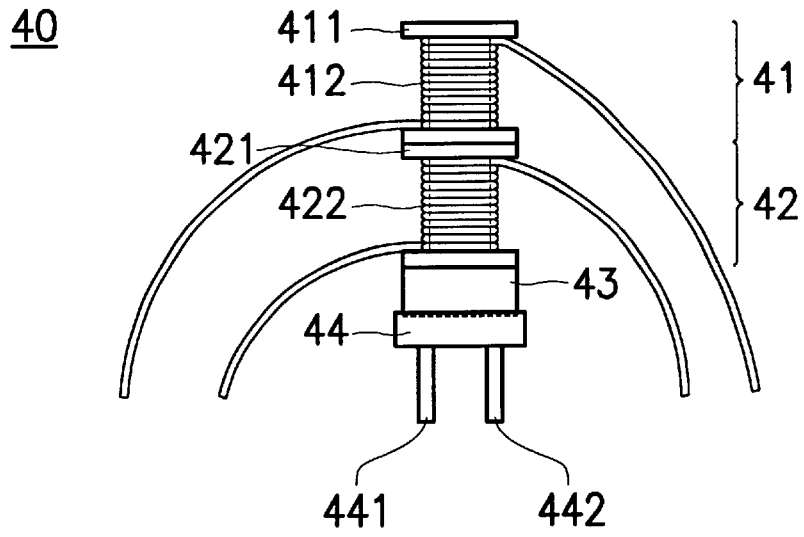
FIG. 5 (PRIOR ART)
FIG. 5 shows a plane view of another conventional linear coil.

Thereby, the base 34 is fixedly disposed on the printed circuit board 11 as shown in FIG. 1 so that the linear coil 30 is electrically connected to the printed circuit board of a display. The spacer 36 is made of an elastic material such as rubber. The adhesion among the compensation part 31, the linearity part 32, the magnetic portion 33, the spacer 36, and the base 34 for composing a complete linear coil 20 is by means of an adhesive such as epoxy.

The linearity part 32 comprises a linearity core 321 and a first wire 322. For example, the linearity core 321 is made of ferrite, and the first wire 322 surrounds the linearity core 321. In addition, one end of the first wire 322 leads to the first connector 351, and the other end of the first wire 322 leads to the second connector 352.

The compensation part 31 comprises a compensation core 311 and a second wire 312. For example, the compensation core 311 is made of ferrite, and the second wire 312 surrounds the compensation core 311. In addition, one end of the second wire 312 leads to the third connector 353, and the other end of the second wire 312 leads to the fourth connector 354.

The structure of the linear coil 30 is therefore described as above. On the other hand, the operating principle of the linear coil 30 is the same as that of a conventional linear coil; hence, the description is herein omitted for briefness.

The differences between the linear coil 30 according to this embodiment and the aforementioned conventional linear coil are described as follows. According to this embodiment, a spacer 36 is disposed between the magnetic portion 33 and the base 34. Because the spacer 36 is made of an elastic material such as rubber, it is used as a vibration-absorbing or damping device. When the deflection current flows through the linearity core 321, an attraction force or a rejection force is generated repeatedly and periodically between the linearity core 321 and the magnetic portion 33, and the possibility of generating vibration due to the linear coil 30 arises. In view of the above disadvantage, the spacer 36 according to this embodiment can absorb such vibration; wherein, the vibration, which is transferred to the printed circuit board via the base 34, can be reduced or inhibited since there is no more collision generated between the linear coil 30 and the printed circuit board. As a result, the acoustic noise can be inhibited effectively.

Furthermore, referring to FIG. 7 and FIG. 8, since there is no notch formed on the linearity core 321 according to this embodiment, a first wire 322 is therefore disposed in contact with the edge of the linearity core 321 as shown in FIG. 8 instead of in contact with the magnetic portion 33. In addition, the vibration is generated synchronously between the first wire 322 and the linearity core 321; therefore, neither friction nor acoustic noise will be generated between these two components. As a result, this embodiment can effectively reduce or inhibit the acoustic noise generated from the friction between the first wire 322 and the magnetic portion 33.

Furthermore, the elastic material of which the spacer 36 according to this embodiment is made of either a rubber or other elastic materials.

Second Embodiment

Figure 9:
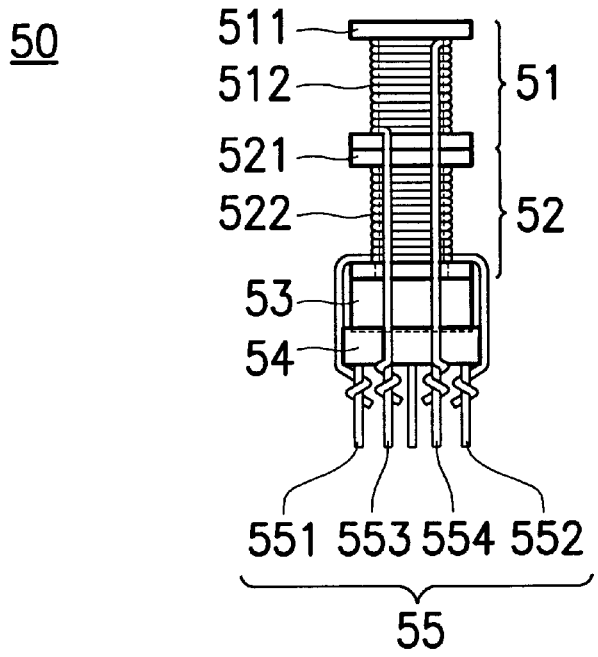
FIG. 9 is a plane view illustrating another embodiment of the linear coil according to the present invention.
Figure 10:
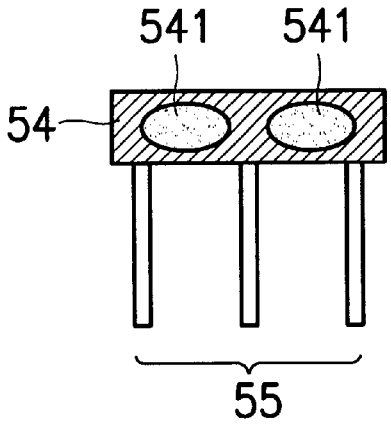
FIG. 10 is a cross-sectional view of the base shown in FIG. 9.

The linear coil according to the second embodiment of the present invention is as shown in FIG. 9 and FIG. 10 of the accompanying drawings. FIG. 9 is a plane view illustrating the second embodiment of a linear coil according to the present invention, and FIG. 10 is a cross-sectional view of the base shown in FIG. 9. The differences between the first embodiment and the second embodiment of the present invention are described as follows. At least an elastic bag 541 is disposed inside the perimeter of the base 54 according to the second embodiment. As shown in FIG. 10, the number of the elastic bags 541 incorporated is two. The elastic bag 541 serves the same function as the spacer 36 of first embodiment. In addition, a compensation part 51, a linearity part 52, a magnetic portion 53, and a plurality of connectors 55 according to this embodiment are assembled together following the same manner and operating principle as the compensation part 31, the linearity part 32, the magnetic portion 33, and the connectors 35, respectively, of the first embodiment; hence, the description is herein omitted for briefness. Furthermore, there is no notch disposed on the linearity part 53 according to this embodiment, which helps to inhibit the acoustic noise.

Furthermore, the elastic bag 541 according to this embodiment is an air bag.

While the present invention has been particularly shown and described with reference to a preferred embodiment, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A linear coil disposed on a printed circuit board, comprising;

a base fixedly disposed on the printed circuit board;

a magnetic portion disposed on the base; and a linearity part having a linearity core and a first wire, wherein the linearity core is disposed on top of the magnetic portion, the first wire surrounds the linearity part, and the two ends of the first wire are electrically connected to the printed circuit board; and a spacer disposed between the base and the magnetic portion, whereby the spacer reduces or inhibits vibration, generated between the magnetic portion and the linearity part, from being transferred to the printed circuit board through the base.

2. The linear coil as claimed in claim 1, wherein the base further comprises a first connector and a second connector made of conductive material for fixing the base on the printed circuit board, the two ends of the first wire are electrically connected to the first connector and the second connector respectively and thus are electrically connected to the printed circuit board.

3. The linear coil as claimed in claim 1, wherein the spacer is made of an elastic material.

4. The linear coil as claimed in claim 1, wherein the elastic material is rubber.

5. The linear coil as claimed in claim 1, further comprising:

a compensation part consisting of a compensation core and a second wire, wherein the compensation core is disposed on the linearity part, the second wire surrounds the compensation core, and two ends of the second wire are electrically connected to the printed circuit board respectively.

6. The linear coil as claimed in claim 5, wherein the base further comprises a third connector and a fourth connector made of conductive material, the two ends of the second wire are electrically connected to the third connector and the fourth connector respectively and thus are electrically connected to the printed circuit board.

7. A linear coil disposed on a printed circuit board, comprising;

a base fixedly disposed on the printed circuit board;

a magnetic portion disposed on the base; and a linearity part having a linearity core and a first wire, wherein the linearity core is disposed on the magnetic portion, the first wire surrounds the linearity part, and the two ends of the first wire are electrically connected to the printed circuit board; characterized in that at least one elastic bag disposed inside the base, whereby the elastic bag reduces or inhibits vibration, generated between the magnetic portion and the linearity part, from being transferred to the printed circuit board through the base.

8. The linear coil as claimed in claim 7, wherein the base further comprises a first connector and a second connector made of conductive material for fixing the base on the printed circuit board, the two ends of the first wire are electrically connected to the first connector and the second connector respectively and thus are electrically connected to the printed circuit board.

9. The linear coil as claimed in claim 7, further comprising:

a compensation part consisting of a compensation core and a second wire, wherein the compensation core is disposed on the linearity part, the second wire surrounds the compensation core, and two ends of the second wire are electrically connected to the printed circuit board respectively.

10. The linear coil as claimed in claim 9, wherein the base further comprises a third connector and a fourth connector made of conductive material, the two ends of the second wire are electrically connected to the third connector and the fourth connector respectively and thus are electrically connected to the printed circuit board.

11. The linear coil as claimed in claim 7, wherein the elastic bag is an air bag.

* * * * *